US009058949B2

(12) United States Patent
Van Beneden

(10) Patent No.: US 9,058,949 B2
(45) Date of Patent: Jun. 16, 2015

(54) THERMAL SWITCH

(75) Inventor: Bruno Van Beneden, Zellik (BE)

(73) Assignee: Vishay Resistors Belgium BVBA, Brussels (Evere) (BE)

( * ) Notice: Subject to any disclaimer, the term of this patent is extended or adjusted under 35 U.S.C. 154(b) by 567 days.

(21) Appl. No.: 13/383,919

(22) PCT Filed: Jul. 15, 2010

(86) PCT No.: PCT/EP2010/004328

§ 371 (c)(1),
(2), (4) Date: Mar. 30, 2012

(87) PCT Pub. No.: WO2011/006663

PCT Pub. Date: Jan. 20, 2011

(65) Prior Publication Data

US 2012/0182116 A1 Jul. 19, 2012

(30) Foreign Application Priority Data

Jul. 15, 2009 (GB) ..... 0912304.3

(51) Int. Cl.

| | |
|---|---|
| ***H01H 37/76*** | (2006.01) |
| ***H01H 71/20*** | (2006.01) |
| ***H01H 85/05*** | (2006.01) |
| *H01H 85/055* | (2006.01) |
| *H01H 85/041* | (2006.01) |

(52) U.S. Cl.

CPC ..... *H01H 37/767* (2013.01); *H01H 85/055* (2013.01); *H01H 37/764* (2013.01); *H01H 85/05* (2013.01); *H01H 2037/768* (2013.01); *H01H 37/761* (2013.01); *H01H 85/0418* (2013.01); *H01H 71/20* (2013.01)

(58) Field of Classification Search

CPC . H01H 37/761; H01H 37/767; H01H 37/764; H01H 2037/768; H01H 85/05; H01H 85/055; H01H 85/0418; H01H 71/20

USPC ..... 337/147, 159, 184, 401, 407, 408

See application file for complete search history.

(56) References Cited

U.S. PATENT DOCUMENTS

| | | | | |
|---|---|---|---|---|
| 1,685,136 | A | 9/1928 | Montgomery | |
| 2,056,118 | A | 9/1936 | Basse | |
| 2,934,628 | A * | 4/1960 | Massar et al. | 337/409 |

(Continued)

FOREIGN PATENT DOCUMENTS

| | | | |
|---|---|---|---|
| GB | 2 156 154 | A | 3/1984 |
| WO | 96/37025 | A1 | 11/1996 |

(Continued)

*Primary Examiner* — Anatoly Vortman

(74) *Attorney, Agent, or Firm* — Volpe and Koenig, P.C.

(57) ABSTRACT

A thermal switch comprises a first and second electrically conducting terminals and a pre-stressable electrically conducting connecting device such as a compression spring member. The connecting device, in a compressed state, contacts at most one of the first and second terminals, and, in a released state, electrically connects the first and second terminals. The thermal switch further comprises a retainer device retaining the connecting device in the compressed state. The retainer device comprises a retaining material that melts at or above a predetermined temperature for releasing the connecting device into the released state. In the compressed state of the connecting device, the first and second terminals are electrically insulated from each other by a hollow space formed between the connecting device and at least one of the first and second terminals.

16 Claims, 2 Drawing Sheets

(56) References Cited

U.S. PATENT DOCUMENTS

| | | | | | |
|---|---|---|---|---|---|
| 3,155,800 | A | * | 11/1964 | Denton | 337/409 |
| 3,180,958 | A | * | 4/1965 | Merrill | 337/409 |
| 3,281,559 | A | * | 10/1966 | Ebensteiner | 337/403 |
| 3,715,700 | A | | 2/1973 | Gloeckler | |
| 3,727,164 | A | * | 4/1973 | Cartier et al. | 337/405 |
| 3,761,856 | A | * | 9/1973 | Mantelet | 337/409 |
| 3,778,742 | A | * | 12/1973 | Merrill | 337/407 |
| 3,781,737 | A | * | 12/1973 | Henry | 337/407 |
| 3,820,050 | A | * | 6/1974 | Tyler et al. | 337/408 |
| 3,930,215 | A | * | 12/1975 | Senor | 337/407 |
| 3,944,960 | A | * | 3/1976 | Audette et al. | 337/408 |
| 4,001,754 | A | * | 1/1977 | Plasko | 337/407 |
| 4,004,263 | A | | 1/1977 | Carney | |
| 4,034,326 | A | | 7/1977 | Hill et al. | |
| 4,060,787 | A | * | 11/1977 | Budnik | 337/408 |
| 4,065,741 | A | * | 12/1977 | Sakamoto et al. | 337/407 |
| 4,068,204 | A | * | 1/1978 | Iwanari et al. | 337/408 |
| 4,075,595 | A | * | 2/1978 | Plasko | 337/407 |
| 4,084,147 | A | * | 4/1978 | Mlyniec et al. | 337/407 |
| 4,126,845 | A | * | 11/1978 | Iimori et al. | 337/408 |
| 4,127,839 | A | * | 11/1978 | Ito et al. | 337/408 |
| 4,160,968 | A | * | 7/1979 | Saini | 337/404 |
| 4,189,697 | A | * | 2/1980 | Hara | 337/407 |
| 4,197,634 | A | * | 4/1980 | Plasko | 29/622 |
| 4,246,561 | A | * | 1/1981 | McVey | 337/407 |
| 4,246,564 | A | * | 1/1981 | Olson et al. | 337/409 |
| 4,276,531 | A | * | 6/1981 | Davis | 337/407 |
| 4,276,532 | A | * | 6/1981 | Aoki | 337/408 |
| 4,281,309 | A | * | 7/1981 | Olson | 337/409 |
| 4,286,248 | A | * | 8/1981 | Hara | 337/403 |
| 4,322,705 | A | * | 3/1982 | Hara | 337/407 |
| 4,326,186 | A | * | 4/1982 | Clay | 337/107 |
| 4,344,061 | A | * | 8/1982 | Niwa | 337/407 |
| 4,352,082 | A | * | 9/1982 | Barry et al. | 337/409 |
| 4,401,965 | A | * | 8/1983 | Backlund et al. | 337/408 |
| 4,411,061 | A | * | 10/1983 | Clapper et al. | 29/622 |
| 4,480,247 | A | * | 10/1984 | Hara | 337/407 |
| 4,486,736 | A | * | 12/1984 | Olson et al. | 337/409 |
| 5,187,463 | A | * | 2/1993 | Di Troia et al. | 337/165 |
| 5,590,010 | A | | 12/1996 | Ceola et al. | |
| 5,706,161 | A | * | 1/1998 | Adam | 361/124 |
| 5,920,251 | A | * | 7/1999 | Shea | 337/140 |
| 6,215,638 | B1 | | 4/2001 | Figueiredo et al. | |
| 6,621,677 | B1 | | 9/2003 | Amundsen | |
| 6,724,292 | B2 | * | 4/2004 | Miyashita et al. | 337/290 |
| 6,809,917 | B2 | | 10/2004 | Charles | |
| 7,652,553 | B2 | * | 1/2010 | Neilly et al. | 337/384 |
| 7,724,122 | B2 | * | 5/2010 | Leach | 337/244 |
| 8,129,648 | B2 | * | 3/2012 | Zimmermann et al. | 218/158 |
| 8,581,686 | B2 | * | 11/2013 | Galla et al. | 337/409 |
| 8,754,740 | B2 | * | 6/2014 | Pinto et al. | 337/126 |
| 2002/0018331 | A1 | | 2/2002 | Takahashi | |
| 2003/0112117 | A1 | * | 6/2003 | Miyashita et al. | 337/407 |
| 2005/0088272 | A1 | * | 4/2005 | Yoshikawa | 337/401 |
| 2005/0179516 | A1 | * | 8/2005 | Yoshikawa | 337/401 |
| 2006/0208845 | A1 | * | 9/2006 | Yoshikawa | 337/159 |
| 2006/0232372 | A1 | * | 10/2006 | Yoshikawa | 337/401 |
| 2006/0273876 | A1 | * | 12/2006 | Pachla et al. | 337/140 |
| 2007/0236324 | A1 | * | 10/2007 | Yoshikawa et al. | 337/401 |
| 2008/0117015 | A1 | * | 5/2008 | Leach | 337/238 |
| 2009/0179729 | A1 | * | 7/2009 | Yoshikawa | 337/401 |
| 2010/0033295 | A1 | * | 2/2010 | Kent et al. | 337/405 |

FOREIGN PATENT DOCUMENTS

| | | | |
|---|---|---|---|
| WO | 99/04474 | A1 | 1/1999 |
| WO | 01/48774 | A1 | 7/2001 |
| WO | 2006/125996 | A1 | 11/2006 |

* cited by examiner

THERMAL SWITCH

CROSS REFERENCE TO RELATED APPLICATIONS

This application is a U.S. National Phase filing based on International Patent Application No. PCT/EP2010/004328, filed Jul. 15, 2010, which claims priority to Great Britain Patent Application No. 0912304.3, filed Jul. 15, 2009, the entire contents of all of which are hereby incorporated by reference as if fully set forth herein.

BACKGROUND OF THE INVENTION

This present disclosure relates to thermal switches.

A thermal switch may be used for protection of an electrical installation connected to a power supply against an electrical fire caused by overheating of deficient electrical contacts such as switch contacts or wiring terminations. In particular, the thermal switch may be provided in proximity to an electrical plug, socket, switch or screw terminal etc. to detect an undue increase in temperature caused by a deficient contact. Upon detection of an undue increase in temperature the thermal switch causes an interruption of the power supply.

The thermal switch may be a device comprising first and second electrically conducting terminals configured such that the device is non-conducting in a first state, and conducting in a second state in response to a detection of a predetermined temperature. The predetermined temperature is, on the one hand, well above temperatures occurring during normal operation and, on the other hand, well below temperatures that may cause an electrical fire. The first and second terminals of the thermal switch may be connected to earth and neutral conductors or earth and live conductors to generate a fault, when the device is in the conducting state, that trips a residual current detector to interrupt the power supply.

WO 2006/125996 A1 discloses thermal switches capable of detecting when a build-up of heat occurs. In an embodiment, the terminals are separated by an electrically insulating spacer made of a material that melts at the predetermined temperature such that, when the spacer melts, the first and second terminals contact each other under a biasing force, thereby activating the thermal switch. Such a meltable material is—in principle—well suited for a thermal switch due to its precisely definable and known melting point. A thermal switch including such an electrically insulating spacer, however, requires a great biasing force for ensuring that the first and second terminals contact each other reliably when the spacer melts. Such great biasing force can alter the state of the insulating spacer prior to its melting temperature, therefore reducing the reliability of the insulating spacer over time.

SUMMARY OF THE INVENTION

One object of this disclosure is to provide a novel and improved thermal switch having a well-defined activation temperature.

Accordingly, the present disclosure provides a thermal switch comprising first and second electrically conducting terminals and a pre-stressable electrically conducting connecting device such as a compression spring member. The connecting device, in a compressed state, contacts at most one of the first and second terminals, and, in a released state, electrically connects the first and second terminals. The thermal switch further comprises a retainer device retaining the connecting device in the compressed state. The retainer device comprises a retaining material that melts at or above a predetermined temperature for releasing the connecting device into the released state. In particular, the connecting device is irreversibly released into the released state. In the compressed state of the connecting device, the first and second terminals are electrically insulated from each other by a hollow space formed between the connecting device and at least one of the first and second terminals.

The thermal switch of the present disclosure comprises the pre-stressable connecting device which is retained in the compressed state by the retaining material at temperatures below the predetermined temperature. At higher temperatures the retaining material melts and releases the connecting device into the released state. In the released state, the connecting device is reliably electrically connected to the first and second terminals.

In contrast to prior art thermal switches, in the non-conducting state of the thermal switch, the electrical insulation between the first and second terminals is provided by the hollow space instead of by a meltable material. The hollow space, e.g. an air gap, replaces the meltable material in this respect. In particular, there is no electrically insulating material melting at or above the predetermined temperature and acting as a spacer located between the connecting device and the first and second terminals in the non-conducting state of the thermal switch. Thus, a lower biasing force is required for the connecting device. Further, there is no risk that residues of the retaining material remain between the first and second terminals impeding the conductibility of the thermal switch in the second state.

In a feature, the retainer device comprises first and second abutment members preferably formed separately from the terminals wherein, in the compressed state of the connecting device, the connecting device is pre-stressed between the first and second abutment members. The first and second abutment members are fixedly attached to each other in the compressed state by means of the retaining material. Thus, the retainer device may be—ignoring the retaining material—an at least two-piece device.

In another feature, the first and second abutment members comprise a sleeve member and a pin member, respectively. An electrically conducting collar is integrally formed with the sleeve member and an electrically conducting head is integrally formed with the pin member for the abutment of the connecting device. Alternatively, the collar and the head may be fixedly attached to the sleeve member and pin member, respectively. Preferably, at least in the compressed state of the connecting device, the pin member is at least partially received in the sleeve member. The sleeve member may therefore serve as a guidance for the pin member. Preferably, in the compressed state of the connecting device, an annular gap is formed between the sleeve member and the pin member. The annular gap is at least partially filled by the retaining material. Such an arrangement is easy to manufacture due to the fact that the retaining material may—in a liquid phase—simply be poured into the sleeve member.

In still another feature, the first and second abutment members comprise a first attachment section and a second attachment section, respectively, for the attachment of the first and second abutment members to each other. At least in the compressed state of the connecting device, the first and second attachment sections are received in the connecting device. Preferably, the first and second attachment sections correspond to the sleeve member and pin member as mentioned above, respectively.

In another feature, the first and second abutment members are moved apart by the connecting device upon the melting of the retaining material.

In yet another feature, in the released state of the connecting device, the connecting device electrically contacts the first and second terminals via the first and second abutment members. Thus, for ensuring electrical connection between the first and second terminals in the second state there is no need that the connecting device directly contacts the first and second terminals. Preferably, the non-direct contact is established via the collar and head as mentioned above, respectively.

The retaining material may comprise an electrically conducting material. Thus, even in the unlikely event that, in the conducting state of the thermal switch, the retaining material gets in between the connecting device and the retainer device, on the one hand, and the first and second terminals, on the other hand, this would not pose a problem since the electrical path between the first and second terminals would not be obstructed.

The thermal switch may comprise a resistor connected in series with the connecting device, in particular a PTC thermistor and/or a fusible resistor. The additional resistor may be used when the thermal switch is connected to earth and live conductors to avoid short-circuiting the live conductor to ground. Preferably, the resistor is configured such that it is moved by the connecting device upon pulling open the first and second abutment members as mentioned above.

In an additional feature, in the compressed state of the connecting device, the connecting device is held captive by the retainer device.

Preferably, the connecting device and the retainer device form a multi-part subassembly of the thermal switch, in particular a three-part subassembly, wherein, in the compressed state of the connecting device, the subassembly is fixedly attached to one of the first and second terminals. The attachment to the first or second terminal may be provided by the retaining material. Alternatively, the subassembly may be movable between the first and second terminals, in particular freely movable along an axis of the thermal switch.

In a further feature, the thermal switch comprises a casing enclosing an internal space formed between the first and second terminals. The retainer device and the connecting device are received in the internal space. Preferably, the first and second terminals comprise a first end cap and a second end cap, respectively, closing an open first front face and an open second front face opposite the first front face of the casing, respectively.

The present disclosure also pertains to an electrical installation comprising at least an earth terminal and a neutral terminal or an earth terminal and a live terminal, and further comprising a thermal switch as explained above, wherein the first terminal of said thermal switch is connected to the earth terminal and the second terminal of said thermal switch is connected to the neutral terminal or the live terminal.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

Figure 1:
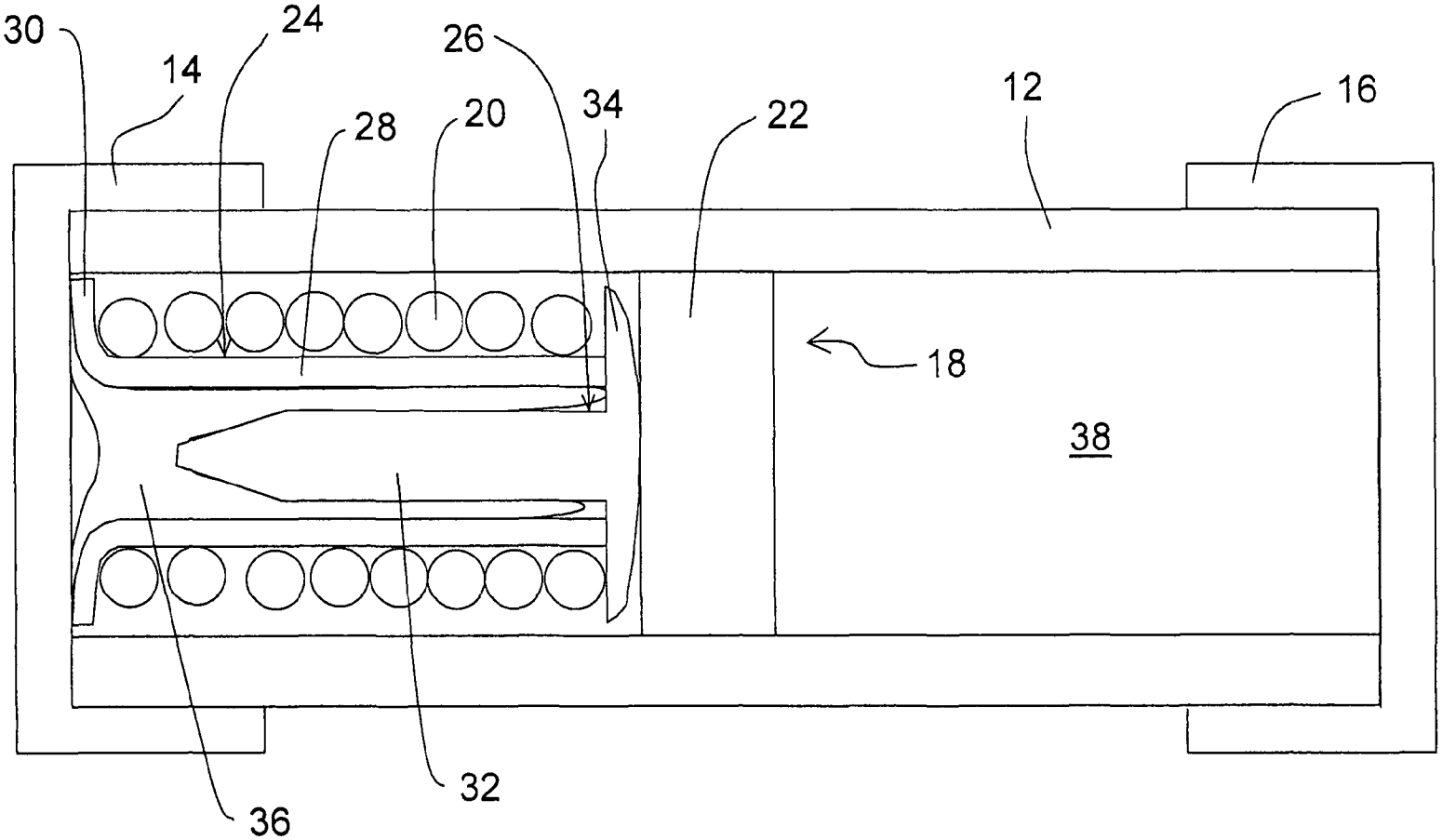
FIG. 1 is a cross-sectional view of a thermal switch in accordance with the present disclosure, wherein a connecting device of the thermal switch is in a compressed state.

The following description is merely exemplary in nature and is not intended to limit the present disclosure, application, or uses. It should be understood that throughout the drawings, corresponding reference numerals indicate like or corresponding parts and features.

Referring now to FIG. 1, an elongate, normally open thermal switch is illustrated. The thermal switch comprises an electrically insulating housing including a tubular casing 12 that encloses an internal space formed between first and second metal end caps 14, 16 of the housing which are provided for closing open first and second front faces of the casing 12. The tubular casing 12 may be made from ceramic or plastic, for instance. The first and second metal end caps 14, 16 act as first and second terminals via which the thermal switch may be connected to earth and neutral conductors or earth and live conductors (not shown). The thermal switch may be provided in proximity to an electrical contact of an electrical installation connected to a power supply to detect an undue increase in temperature which may be caused by a deficient contact.

A subassembly 18 is received within the housing 12, 14, 16. The subassembly 18 includes a connecting element designed as a helical spring 20 and a retainer device 24, 26, 36. The helical spring 20 may be made from stainless steel or the like. The retainer device 24, 26, 36 comprises electrically conducting first and second metal abutment members 24, 26. The first abutment member 24 comprises a sleeve (or ferrule) 28 and a circumferential collar 30 integrally formed with the sleeve 28 on that end of the sleeve 28 that faces the first metal end cap 14 and extending radially outwardly from the sleeve 28. The second abutment member 26 comprises a pin 32 and a head 34 integrally formed with the pin 32 on that end of the pin 32 that faces the second metal end cap 16. The pin 32 is at least partly received within the sleeve 28. The pin 32 and the sleeve 28 are in turn received within the helical spring 20.

FIG. 1 illustrates a compressed state of the helical spring 20 which corresponds to a non-activated, non-conducting state of the thermal switch. In the compressed state of the helical spring 20, the helical spring 20 is pre-stressed between the collar 30 and the head 34. The sleeve 28 and the pin 32 which act as first and second attachment sections of the above-mentioned abutment members 24, 26 are fixedly attached to each other by means of a solid, electrically conducting retaining material 36 which for manufacture of the thermal switch is poured into an annular gap formed between the sleeve 28 and the pin 32. As a matter of course, the retaining material 36 is heated to a temperature above its melting point to enable the pouring. Thus, the helical spring 20 is held captive by the retainer device 24, 26, 36 in a pre-stressed state. The helical spring 20 and the retainer device 24, 26, 36 are undetachably coupled to each other in the non-activated state of the thermal switch.

The retaining material 36 may be a metal compound or metal alloy, preferably lead(Pb)-free, having an eutectic melting temperature in the range of 50° C. to 200° C., for instance, such as an indium-bismuth-alloy having a melting temperature of e.g. 72° C.

In addition, the subassembly 18 is fixedly attached to the first metal end cap 14 by the retaining material 36 to prevent movement of the subassembly 18 within the above-mentioned internal space of the tubular casing 12. The subassembly 18, however, does not contact the second metal end cap 16. Rather, the subassembly 18 is electrically insulated from the second metal end cap 16 by a hollow space 38 that is formed between the subassembly 18 and the second metal end cap 16. Alternatively, the subassembly 18 may be movable within the tubular casing 12 or fixedly attached to the tubular casing 12 such that the hollow space 38 is formed on both sides of the subassembly 18. Preferably, the hollow space 38 is filled with air. Preferably, the hollow space 38 has a breakdown voltage of 2 kV or greater, in particular 3 kV or greater.

The retaining material 36 melts at or above a predetermined temperature. Upon melting of the retaining material 36 the retaining property of the retaining material 36 disappears allowing the helical spring 20 to break open the subassembly 18 and to irreversibly decompress into a released state illustrated in FIG. 2 which corresponds to an activated, conducting state of the thermal switch. In the released state of the helical spring 20, the abutment members 24, 26 are detached from each other and pushed away from each other by the helical spring 20 such that the collar 30 of the sleeve 28 and the head 34 of the pin 32 are pressed against the first and second metal end caps 14, 16. The hollow space 38 has disappeared.

Figure 2:
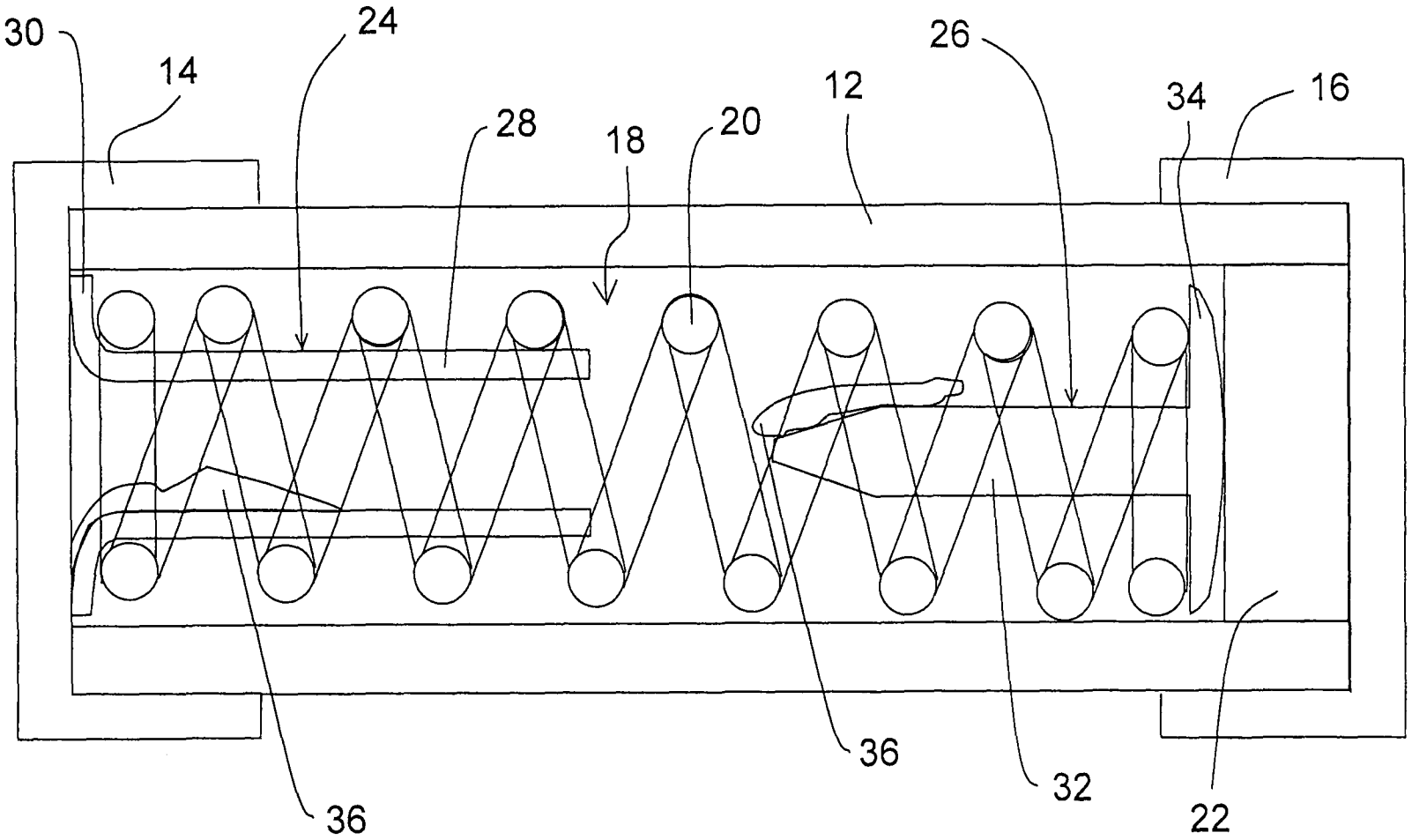
FIG. 2 is a cross-sectional view of the thermal switch of FIG. 1, wherein the connecting device is in a released state.

The internal space including the former hollow space 38 enclosed by the casing 12 and formed between the first and second metal end caps 14, 16 is now entirely occupied by the extended subassembly 18. In FIG. 2, first and second parts of the retaining material 36 which again solidifies after an interruption of the power supply to the electrical installation are stuck to the first abutment member 24 and second abutment member 26, respectively. However, any other arrangement or spreading of the retaining material 36 is possible in the activated state of the thermal switch.

Preferably, in the released state of the helical spring 20, the helical spring 20 is still pre-stressed to ensure a low contact resistance between each of the first metal end cap 14 and the collar 30, the collar 30 and the helical spring 20, the helical spring 20 and the head 34, and the head 34 and the second metal end cap 16.

Thus, in the released state of the helical spring 20, the helical spring 20 is electrically connected to the first and second metal end caps 14, 16 via the collar 30 and head 34. As a consequence, the first and second metal end caps 14, 16 are electrically connected to each other, i.e. the thermal switch 20 is in an electrically conductive state which state may be utilized to trip a residual current detector to interrupt the power supply.

Additionally, the subassembly 18 may comprise a resistor 22 that is connected in series with the helical spring 20. The resistor 22 may be a thermistor, in particular a ceramic PTC (positive temperature coefficient) thermistor, which can limit the electrical current flow in a certain time frame. The resistor 22 may also be a normal linear resistor or a fusible resistor able to interrupt electrical current levels of certain amplitude. Preferably, the resistor 22 is used if the thermal switch is connected between earth and live conductors to limit the fault current to a pre-defined value. The resistor 22 may be omitted if the thermal switch is connected between earth and neutral conductors.

In principle, it would be also feasible to design a thermal switch which is similar to the thermal switch described above in that a helical spring is used wherein, however, the retainer device as described above is omitted and the hollow space is filled with an electrically insulating spacer made of a material that melts at the predetermined temperature. Such a design, however, is disadvantageous. This is due to the fact that such a switch is susceptible to malfunction if residues of the electrically insulating spacer remain between the helical spring and at least one of the first and second terminals although the spacer has melted. This is also due to the fact that such an electrically insulating spacer can be altered or reduced in thickness, prior to its predetermined melting temperature, thereby reducing the long-term reliability of the component.

Those skilled in the art can now appreciate from the foregoing description that the broad teachings of the present disclosure can be implemented in a variety of forms. Therefore, while this disclosure has been described in connection with particular examples thereof, the true scope of the disclosure should not be so limited since other modifications will become apparent to the skilled practitioner upon a study of the drawings, the specification and the following claims.

The invention claimed is:

1. A thermal switch comprising:

a casing defining an internal space;

first and second electrically conducting terminals, the first and second electrically conducting terminals comprising first and second end caps positioned at opposite ends of and enclosing the casing;

a connecting device positioned within the casing comprising an electrically conducting compression spring and a pin in electrical communication with the spring, the pin having a head portion at an end of the pin;

said connecting device, in a compressed state, contacting at most one of said first and second terminals, and, in a released state, electrically connecting said first and second terminals; and a retainer device positioned within the casing retaining said connecting device in said compressed state, the retainer device comprising a sleeve, at least a portion of the pin received within the sleeve, the sleeve contacting the head portion of the pin at an end of the sleeve when the connecting device is in said compressed state;

said retainer device comprising a retaining material that melts at or above a predetermined temperature for irreversibly releasing said connecting device into said released state;

wherein, in said compressed state of said connecting device, said first and second terminals are electrically insulated from each other by a hollow space formed between said connecting device and at least one of said first and second terminals;

wherein the entire connecting device is positioned between the first and second end caps in both the compressed state and the released state.

2. The thermal switch according to claim 1, further comprising first and second abutment members;

wherein, in said compressed state of said connecting device, said spring is pre-stressed between said first and second abutment members;

said first and second abutment members being fixedly attached to each other in said compressed state by means of said retaining material.

3. The thermal switch according to claim 2, wherein said first and second abutment members comprise the sleeve and the pin, respectively; an electrically conducting collar being integrally formed with said sleeve and said head portion being integrally formed with said pin.

4. The thermal switch according to claim 3 wherein, in said compressed state of said connecting device, an annular gap is formed between said sleeve and said pin; said annular gap being at least partially filled by said retaining material.

5. The thermal switch according to claim 2, wherein said first and second abutment members comprise a first attachment section and a second attachment section, respectively, for attachment of said first and second abutment members to each other.

6. The thermal switch according to claim 2 wherein said first and second abutment members are moved apart upon said melting of said retaining material.

7. The thermal switch according to claim 2 wherein, in said released state of said connecting device, an electrical connection is formed between said first and second terminals via said first and second abutment members.

8. The thermal switch according to claim 1 wherein said retaining material comprises an electrically conducting material.

9. The thermal switch according to claim 1 wherein said thermal switch comprises a resistor connected in series with said connecting device.

10. The thermal switch according to claim 1 wherein said connecting device and said retainer device form a multi-part subassembly of said thermal switch; and wherein, in said compressed state of said connecting device, said subassembly is fixedly attached to one of said first and second terminals or movable between said first and second terminals.

11. The thermal switch according to claim 1, wherein said casing comprises an electrically insulating casing.

12. The thermal switch according to claim 1, wherein at least a portion of said sleeve is received within said spring.

13. The thermal switch according to claim 2 wherein said first and second abutment members are formed separately from the terminals.

14. The thermal switch according to claim 9 wherein said resistor comprises at least one of a PTC thermistor and fusible resistor.

15. A thermal switch comprising:

first and second electrically conducting terminals;

an electrically conducting connecting unit comprising an electrically conducting compression spring, an electrically conducting sleeve member having a sleeve portion and a collar portion, and an electrically conducting pin member having a pin portion and a head portion; and a retaining material that melts at or above a predetermined temperature for irreversibly releasing said connecting unit into a released state;

wherein, in a compressed state of said connecting unit, said compression spring is compressed between said collar portion of said sleeve member and said head portion of said pin member, said pin portion being at least partially received in said sleeve portion, and said pin portion and said sleeve portion being received within said compression spring, said pin member and said sleeve member being fixedly attached to each other by means of said retaining material;

wherein, in said compressed state of said connecting unit, said first and second terminals are electrically insulated from each other by a hollow space formed between said connecting unit and at least one of said first and second terminals; and wherein, in said released state, said connecting unit electrically connects said first and second terminals, wherein an electrical connection between said sleeve member and said pin member is made via said compression spring.

16. The thermal switch according to claim 15, wherein, in said compressed state of said connecting unit, an annular gap is formed between said sleeve portion and said pin portion, said annular gap being at least partially filled by said retaining material.

* * * * *